United States Patent [19]

Tezuka et al.

[11] 4,084,662

[45] Apr. 18, 1978

[54] CONTROL APPARATUS FOR AN ELEVATOR SYSTEM

[75] Inventors: Minoru Tezuka, Yokohama; Yastami Kito, Tokyo, both of Japan

[73] Assignees: Nippon Otis Elevator Company; Kabushiki Kaisha Meidensha, both of Tokyo, Japan

[21] Appl. No.: 671,815

[22] Filed: Mar. 30, 1976

[30] Foreign Application Priority Data

Sep. 1, 1975 Japan ..... 50-120473
Sep. 1, 1975 Japan ..... 50-120474

[51] Int. Cl.[2] ..... B66B 1/30
[52] U.S. Cl. ..... 187/29 R
[58] Field of Search ..... 187/29

[56] References Cited

U.S. PATENT DOCUMENTS

| | | | |
|---|---|---|---|
| 3,435,916 | 4/1969 | Bell et al. | 187/29 |
| 3,523,232 | 8/1970 | Hall et al. | 187/29 |
| 3,552,524 | 1/1971 | Benjamin et al. | 187/29 |
| 3,627,080 | 12/1971 | Yuminaka et al. | 187/29 |

*Primary Examiner*—Robert K. Schaefer
*Assistant Examiner*—W. E. Duncanson, Jr.
*Attorney, Agent, or Firm*—Haseltine, Lake & Waters

[57] ABSTRACT

A control apparatus for an elevator system in which a rotation speed of a drive motor for driving said elevator system is controlled by supplying a deviation signal obtained by comparing a speed signal of said drive motor including an induction motor with a driving pattern setting signal; said control apparatus comprising a speed control circuit which includes a control amplifier, and is characterized in that a time constant value of the control amplifier is set to different values in constant running operation and in retardation control of the elevator. Additionally, said control apparatus is characterized that the time constant value in retardation control is set so as to make low a transient gain of said control amplifier, and further that a preselected bias is supperimposed to a time constant circuit of said control amplifier at an alternating point from a constant speed running to a slowing down of the elevator, in order to prevent the decrement of the transient gain.

4 Claims, 11 Drawing Figures

CONTROL APPARATUS FOR AN ELEVATOR SYSTEM

Figure 1:
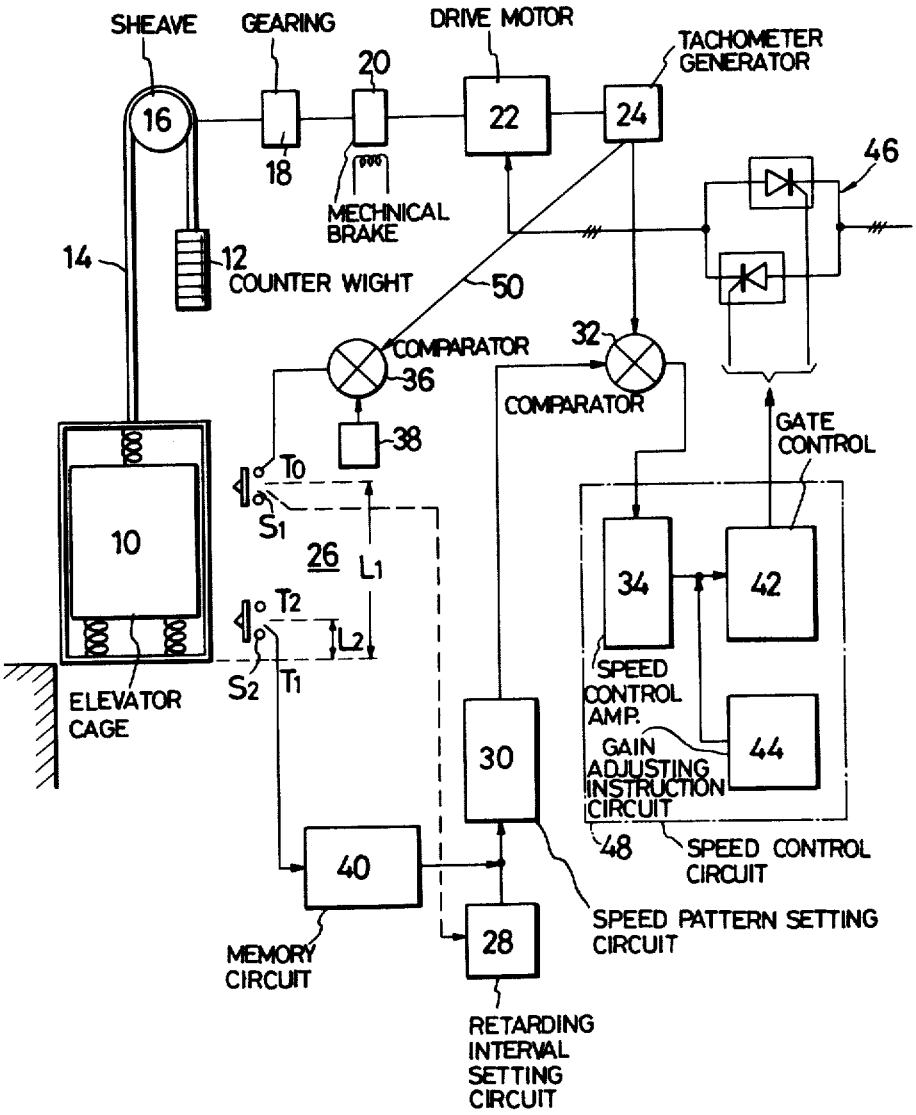

The present invention relates a control apparatus for an elevator system, and more particularly to an improvement of an retarding control device for an elevator system of a feedback control type, which employs an alternating-current motor as a drive motor.

In an elevator system which is controlled by a feedback control system, suitable driving patterns are, generally, set for up and down travels of the elevator cage, and a primary voltage of a drive motor is adjusted by means of a control device for controlling the power to be supplied to the drive motor so as to make the speed of the elevator cage follow the speed decided by the suitable patterns.

It is, however, difficult to obtain an ideal driving characteristic, in case the delay of following occurs in a control system at a time point where the elevator is transferred into a slowing down state from a steady running state, that is, at the commencement of braking in the drive motor. On the other hand, if a transient response of the control system is made fast in order to prevent the delay of following of the control system, an electrical control system is apt to yield the resonance with vibration components of a mechanical system such as, for example a spring and a rope of the elevator. Although a good transient following characteristic of the electrical control system may be obtained, the elevator becomes uncomfortable to ride, as a whole, It is, therefore, necessary to reduce the transient response speed of the control system for the purpose of preventing the resonance due to the various vibrating components of the elevator and the oscillating components of the control system.

To the contrary, reducing the transient response speed of the control system causes the delay of following of an actual speed of the elevator with respect to the ideal speed setting pattern, and as a result, a preferable following characteristic may not be obtained because the elevator may overshoot the starting point at which it should be reduced the speed of the elevator.

The more important drawbacks in a conventional control system is fact that, if the drive motor is changed over from the motoring and driving state into the retarding state, a resudial voltage often develops from the motor, and an abnormal current often flows into the motor windings, which is not proportional to the control signal supplied from the control system due to the interference between a voltage phase of the resudial voltage and a voltage phase of the power source, and as a result a power fuse is welded and the circuit elements are destroyed in addition to the generations of the powerful retarding torque and the strong vibration. The elevator, therefore, becomes uncomfortable condition to ride due to the strong vibration.

An important matter is the controlling of a landing position when the elevator cage is conditioned to run at retarding and slowing down state, as well as the solvation of problems as to uncomfortable to ride of the elevator. The stop position of the elevator cage various depending on a load carried by the elevator. In order to reduce a stop position error, a commonly used method is that a number of position check switches are provided on set-points in a retardation course, and, furthermore, the speed are previously set corresponding to each position check switch by means of forming a retarding pattern as a speed pattern corresponding to the position of the elevator cage, and thereby the landing position control is performed in order to follow the control system to each retarding pattern when the elevator cage arrives at the retardation starting point.

These systems have the drawbacks, however, that the equipment furnishing a continuous velocity set-points or reference value as a function of distance is complex, expensive, difficulty of speed adjustments in each position, and often displays poor reliability in service.

It is, therefore, an object of the invention is to provide a control apparatus for an elevator system, which enables to initiate the retardation smoothly by means of eliminating the transient gain and by increasing the initiation response speed of a control system.

Another object of the invention is the provision of a control apparatus for an elevator system, which can obtain the smooth retardation operation by changing over the time constant of the control system and by reducing the transient gain at a time point where an elevator cage alternate to the retarding conditions from the constant speed running condition and which can obtain an ideal driving pattern by means of giving and superimposing a desired bias in a point where the elevator is changed over from a constant speed running state to the slow down condition.

An important object of the invention is the provision of an elevator control apparatus in which the elevator speed is follow-up controlled with respect to a predetermined speed pattern, and may control the landing position acculately by means of correcting the stop position error due to the weight of load.

With above in view the more important feature of the present invention is the fact that the apparatus comprises a time function generating circuit operated by means of the retarding instruction supplied from the elevator and for generating a speed instruction output signal such as an output voltage which decreases linealy to zero when the elevator cage approaches to a stop position in a distance of the elevator travelling, a correcting instruction circuit for storing an error signal between a speed value of a drive motor or a speed instruction signal of the time function generating circuit and a reference speed setting value and for supplying a correcting signal proportioning to the error signal, and means for correcting a tangent of a output waveform of the time function generating circuit and for rendering the speed of the elevator to zero at a preselected stop position.

Another feature of the invention is characterized in fact that a time constant of an amplifier is set respectively different values in constant speed running operation and in retardation control of the elevator, and that the time constant value in the retardation control is set so that a transient gain of the amplifier become low and further that a preselected bias is super-imposed to a time constant circuit at an alternating point from a constant speed running to a slowing down running of the elevator, in order to prevent the decrement of the transient gain.

Figure 2A:
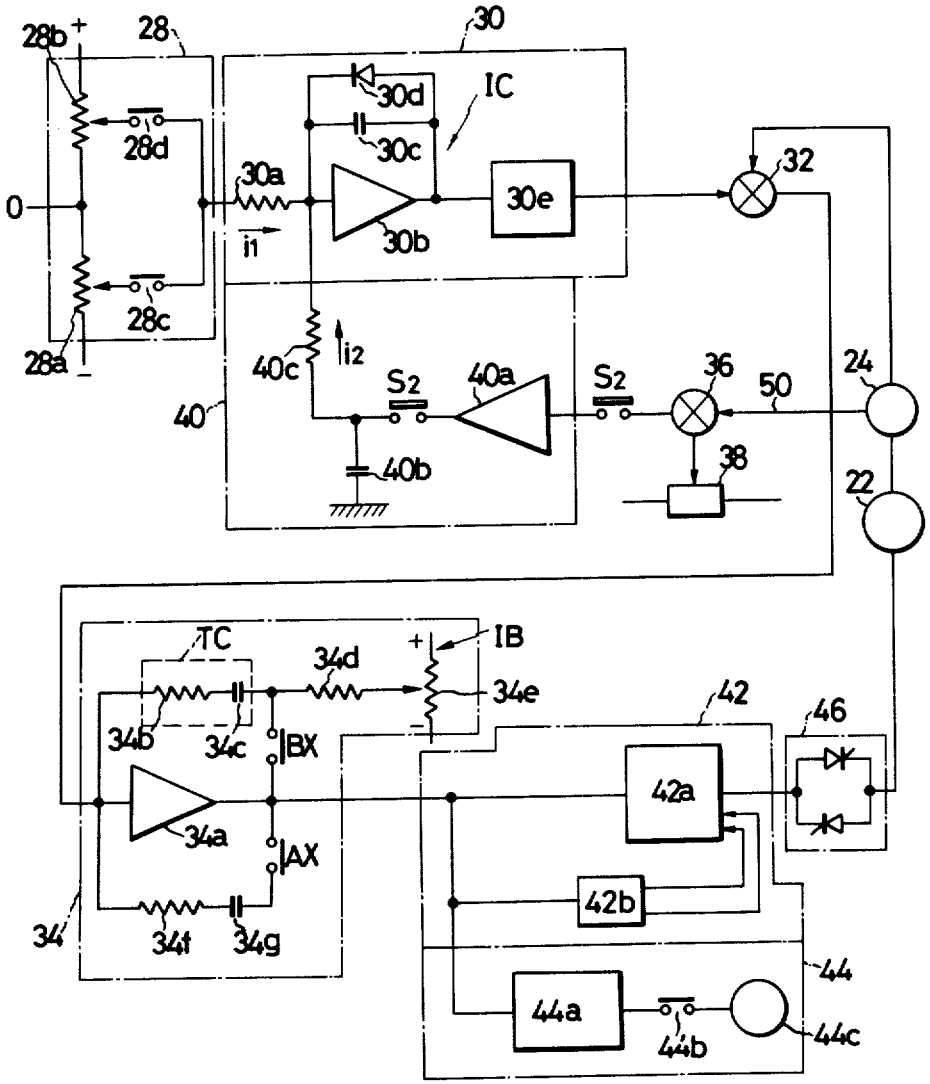
Figure 2B:
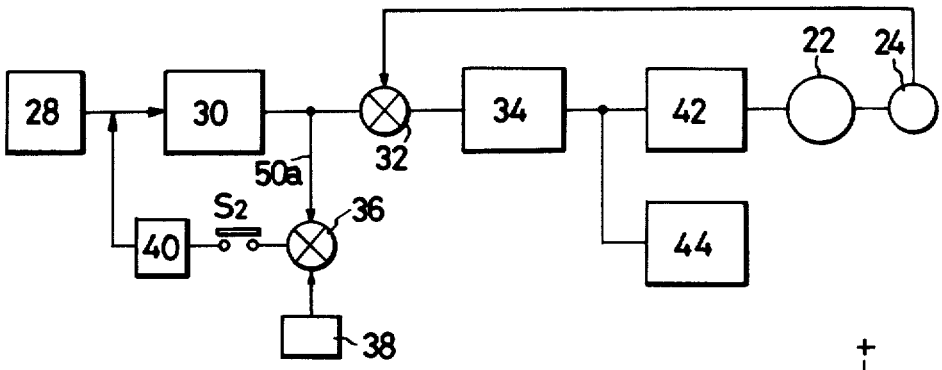
Figure 3:
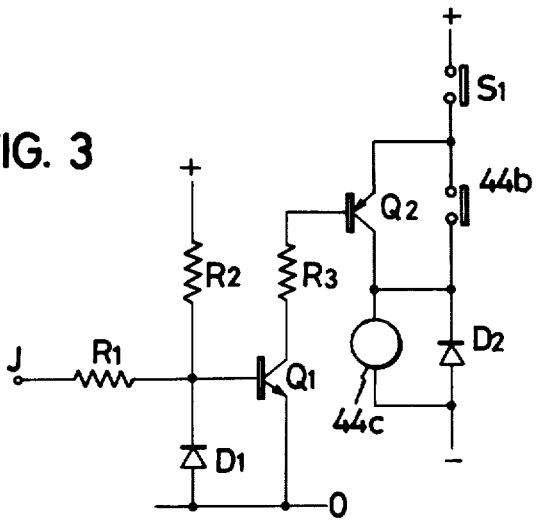
Figure 4:
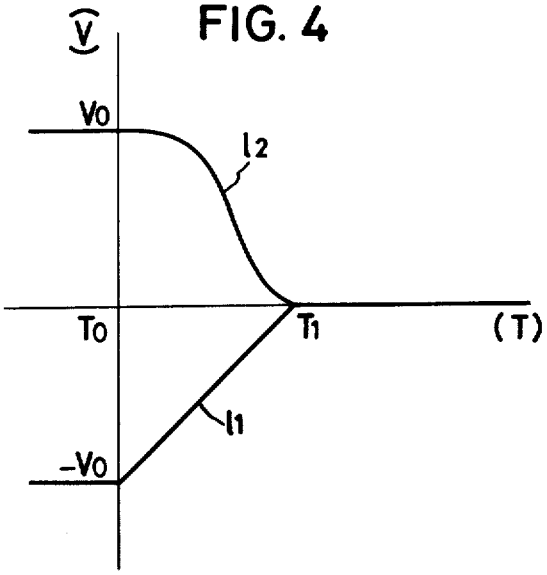
Figure 5A:
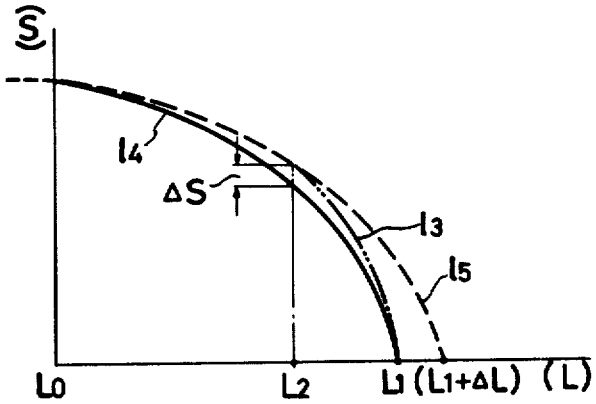
Figure 5B:
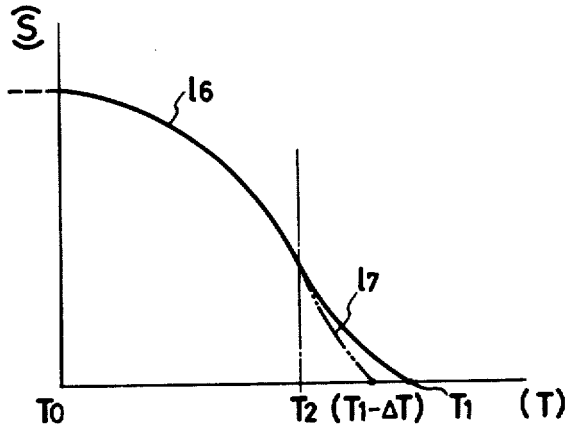
Figure 6A:
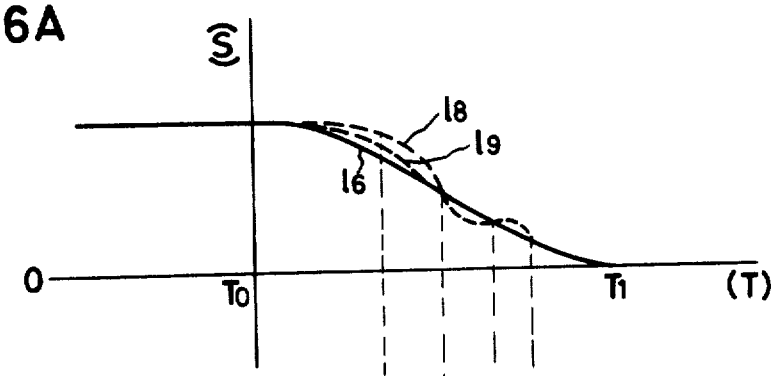
Figure 6B:
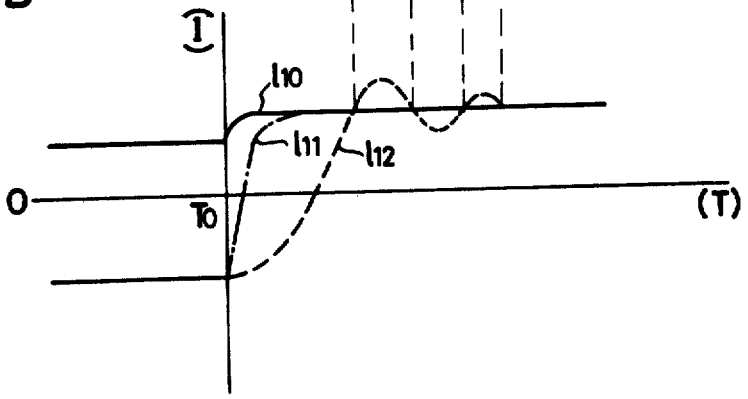
Figure 6C:
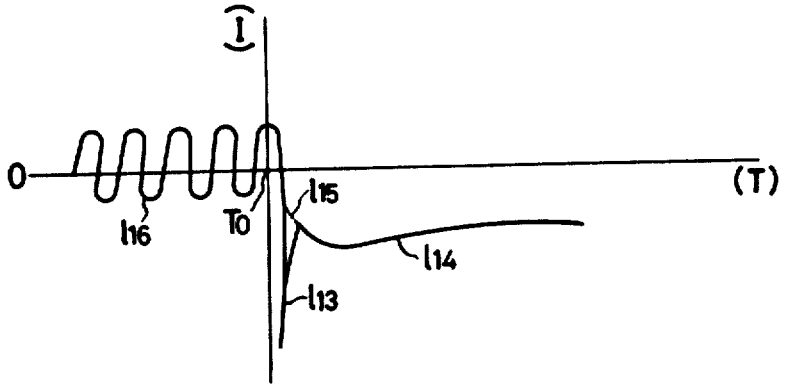
Figure 7:
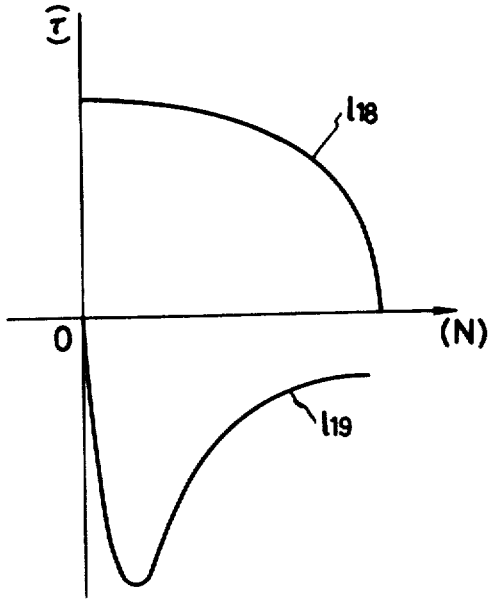

Other objects and features of the invention will be apparent from the following description taken in conjunction with the accompanying drawings in which:

FIG. 1 is a schematic presentation of the components comprised in the elevator drive system, FIG. 2A is a circuit diagram, partly in block diagram form, of the control apparatus, FIG. 2B is a block diagram of a modification of the control apparatus in FIG. 2A, FIG. 3 is a circuit diagram of a voltage relay may use in the control apparatus of the invention, FIG. 4 is a graph of the output voltage of a speed pattern setting circuit as a function of time of the invention, FIGS. 5A and 5B are graphical presentations of the requisit compensations of the speed patterns according to the present invention, FIGS. 6A to 6C are graphical presentations of the requisit retardations, as a function of time in the control apparatus of the elevator, according to the invention, and FIG. 7 is a graph presentation of the torque of an induction motor using as a drive motor for an elevator system.

Referring now in detail to these figures, the principal components of the elevator driving system according to the present invention as an elevator cage 10 is connected to a counterweight 12 by a cable 14. A sheave 16 is interposed between the cage 10 and the counterweight 12. A drive motor 22 is connected to the sheave 16 through a gearing 18 and a mechanical brake 20. A tachometer generator 24 is connected to the motor 22. A cage position check device 26 is provided, and in this exemplary instance, a retarding instruction switch S1 and a position check switch S2 are provided per stopping level. Only the device belonging to one stopping level have been shown in the drawing.

In the present invention, a speed pattern is preformed as a function of time during a starting point of the retardation to a landing position at which the elevator should stop and is made following the preformed speed pattern for the purpose of landing the elevator at floor. The following characteristics to the speed pattern, however, alternate in accordance with the load carried by the elevator cage.

For the purpose of enhancing the accuracy of the stop operation of the elevator, a position check switch is disposed at a reference point where the distance is predetermined value from the stopping position of the elevator, and a speed pattern as a function of time is corrected and adjusted in accordance with an error which is obtained by means of comparing a reference velocity and an actual and momentary speed in arriving of the elevator cage to the reference point. In the present invention, two switches may be provided in the position check device at each floor of a building.

The control system of the invention consists of a speed pattern setting circuit 30 starting the operation in receiving a retardation instruction supplied from the retardation starting instruction switch S1 and generating an output signal reducing linearly for a preset time interval. And the control system according to the present invention includes a first comparator circuit 32 for receiving an output signal of the speed pattern setting circuit 30, a speed control circuit 48 including an amplifier which receives an output signal from the first comparator circuit 32 and which controls the rotation speed of a drive motor 22, and a tachometer generator 24 for detecting the rotation speed of the drive motor 22.

Furthermore, the speed control circuit 48, as shown in FIG. 1, includes a control amplifier circuit 34 for receiving a deviation signal from the first comparator 32, a gate control circuit 42 for regulating a power switch 46 depending on the output signal of the control amplifier circuit 34 and a gain adjusting instruction circuit 44 actuating in accordance with the output signal of the control amplifier circuit 34 for the purpose of adjusting the gain of the circuit 34.

In the apparatus of the present invention, an output signal of a tachometer generator 24 is matched to the output signal presented from the speed pattern setting circuit 30 by means of feeding back to the first comparator circuit 32, and, furthermore, provided are a reference speed setting circuit 38 and a second comparator circuit 36. At the second comparator circuit 36, an output signal of the reference speed setting circuit 38 is mached and compared with the output signal of the tachometer generator 24. The output signal supplied from the second comparator circuit 36 is supplied to a correcting instruction circuit such as, for example, a memory circuit 40 by way of the reference position check switch S2 which is positioned in the hoistway at the near position from the floor than that of the retardation starting instruction switch S1. The memory circuit 40 memories the deviation and error output signal from the second comparator circuit 36, which is obtained responding to the instruction presented from the position check switch S2, and which, at the same time, supplys the memory signal to the speed pattern setting circuit 30. Thereby, changed is the tangent of an output voltage waveform of the speed pattern setting circuit 30.

The elevator system in the present invention also includes a conventional mechanical holding brake, which has been shown by only block in FIG. 1, for the sake of simplicity.

In the case considered as an example, the elevator is considered to be braked in a previously known manner, by supplying direct current to an appropriate stator winding of an induction motor.

The principal components of the control apparatus are shown in greater detail by FIG. 2A. As is best shown in FIG. 2A, the retardation interval setting circuit 28 comprises variable resistors 28a and 28b serially connected each other between positive and negative terminals, a contact 28c connected to a tap of the variable resistor 28c and a contact 28d connected to a tap of the variable resistor 28b. The contacts 28c and 28b become ON and OFF states in accordance with the signal from the elevator cage 10.

The speed pattern setting circuit 30 includes a time function generator such as an integration circuit IC and a conventional speed pattern transducer 30e wherein an ideal running pattern is set for an ideal driving of the elevator. The integration circuit IC includes a resistor 30a connected to the variable resistors 28c and 28d, an amplifier such as an operation amplifier 30b connected to the resistor 30a, a capacitor 30c connected in parallel relationship with the operation amplifier 30a and a diode 30d connected in reverse and parallel relationship with the operation amplifier 30a. A control amplifier circuit 34 is connected in series relationship with the speed pattern setting circuit 30 by way of a first comparator circuit 32. A memory circuit 40 is connected in parallel relationship with the speed pattern setting circuit 30 by way of the second comparator circuit 36 and the position check switch S2.

As is best shown in FIG. 2A, the memory circuit 40 includes an amplifier such as, for example, an operation amplifier 40a, a resistor 40c connected in series with the operation amplifier 40a through the position check switch S2, a capacitor 40b interposed between a ground and the resistor 40c.

In a control loop consisting of the retardation time setting circuit 28, the speed pattern setting circuit 30 and the memory circuit 40, as will be described in greater detail, the elevator cage 10 makes the retardation starting switch S1 ON state (see FIG. 1). The closure of the switch S1 causes the contact 28c for retardation to ON state and, at the same time, the contact 28d to OFF state, and thereby the speed pattern setting circuit 30 starts the operation thereof. The output signal of the speed setting circuit 30 is supplied to the first comparator circuit 32 and the second comparator circuit 36. The output signal of the second comparator circuit 36 is matched to the reference speed setting signal of the setting circuit 30, and thereafter the deviation signal proportional to a difference between a speed pattern signal of the circuit 30 and the reference signal of the circuit 38. The memory circuit 40 begins to operate responding to a retardation signal supplied from the retardation instruction switch S1, and memories the deviation signal supplied from the second comparator circuit 36, at the moment of closing of the reference position check switch S2, and then feeds back the memory signal to the speed pattern setting circuit 30.

In the first comparator circuit 32, the output signal supplied from the speed pattern setting circuit 30 is compared with the output signal of the tachometer generator 24, which is proportioned to the rotation speed of the drive motor 22. If there is, in this case, a difference between a set value of the ideal pattern and an actual value of the driving motor rotation, the deviation signal is presented to the control amplifier circuit 34 from the first comparator circuit 32. The deviation signal varies corresponding to the load carried by the elevator cage 10.

The control amplifier circuit 34 has an amplifier such as an operation amplifier **34*a* for amplifying the deviation output signal which is proportion to the error detected in the first comparator circuit 32 and for controlling the rotation speed to the preset speed, a transient gain constant circuit TC consisting of a resistor 34*b* and a capacitor 34*c* and for eliminating the transient gain at the time of slowing down the elevator speed, and a initiation biassing circuit IB including a contact BX which is made ON state by a signal supplied from a gain adjusting instruction circuit 44, as explained hereinafter. The transient gain adjusting instruction circuit IB is, as shown in FIG. 2A, connected in parallel with the operation amplifier 34*a*, and, further, the variable resistor 34 is connected to a juncture between the capacitor 34*c* and the contact BX by way of the resistor 34*c***.

Furthermore, within the speed control amplifier 34, a resistor **34*f* and a capacitor 34*g*** decide a time constant of the transient gain during the accelerating running and the constant running of the elevator, and the contact AX remains the ON state at the time of accelerating and constant running.

The gate control circuit 42 includes a commonly used phase control circuit **42*a*, a discriminator 42*b* for supplying a control signal to the phase control circuit 42*a* by means of discriminating the output of the control amplifier circuit 34**.

An output polarity of the control amplifier 34 changes depending on the load carried by the elevator, and the discriminator **42*b* detects the output polarity of the control amplifier 34 and supplys a retardation control signal for rendering the drive motor 22 to the retarding state, or a motoring signal for making the drive motor 22 to the motoring condition to the phase control circuit 42*a***.

The gain adjusting instruction circuit 44 includes a zero voltage detecting circuit such as, for example, a voltage relay 44a for detecting that the output polarity of the control amplifier 34 is zero, a relay **44*c* which is energized by the retardation instruction of the elevator, and a switch 44*b* which is closed by the retardation signal of the elevator. An undervoltage relay, in this instance, may be used as a voltage relay 44a**.

FIG. 3 shows a practical used under-voltage relay as the voltage relay **44*a* which comprises a resistor $R_1$ junctured to a output terminal J of the control amplifier 34, a resistor $R_2$ connected to a positive potential having a constant voltage value, a transistor $Q_1$ whose base electrode is connected to resistors $R_1$ and $R_2$, diodes $D_1$ and $D_2$, and a transistor $Q_2$, and is connected as shown in FIG. 3**.

Referring once again to FIG. 2A of the drawing, the operation of the control apparatus of the invention will be described in greater detail.

When the elevator cage 10 approaches to the determined distance $L_1$ from the stop position, the retardation starting instruction switch S1 is turned ON state. By closure of the switch S1, the integration circuit IC begins to operate, and then generates the output voltage which damps to zero during the time interval $T_1$ decided by the speed of the elevator and the position where the switch S1 is located, as indicated by a curve $l_1$ in FIG. 4.

The output voltage of the integration circuit IC is applied to a speed pattern transducer **30*e* which includes a conventional operation amplifier. The speed pattern transducer 30*e* forms a speed pattern for enabling the elevator to be comfortable to ride, as is shown by a curve $l_2$ in FIG. 4. When the cage 10 arrives at the position where the distance is $L_2$ from the stop position, the reference position check switch S2 is momentary made ON state, and thereby a closed loop is formed in the feedback loop including the memory circuit 40. When the closed loop is formed, the output value of the tachometer generator 24 is compared, in the second comparator 36, with the reference setting value of the reference speed setting circuit 38, and if there is the difference in both values, the deviation and error value is stored in the memory circuit 40. In the memory circuit 40, the amplifier 40*a* amplifies the deviation and error signal supplied from the second comparator 36, and the amplified deviation signal is charged on the capacitor 40b. An electric charge stored in the capacitor 40b is supplied to the speed pattern setting circuit 30 as a current $i_2$, for the purpose of correcting the output voltage of the circuit 30. In the speed pattern setting circuit 30, the integration circuit IC integrates the deviation value components due to the difference value between an input current $i_1$ and the current $i_2$ which is decided by the resistor 30*a* and the capacitor 30*c***. The integrated deviation value components changes the tangent of the output voltage waveform of the integration circuit IC in order to correct the speed of the elevator to zero at the landing position which it should be a floor.

FIG. 5A shows various characteristics curves the speed (L) with respect to the running position (L) of the elevator cage 10. In the FIG. 5A, curves $l_3$ denotes a corrected characteristics by means of the control apparatus according to the present invention, $l_4$ shows a characteristics of the speed pattern setting circuit 30 setted to the reference speed pattern, and curves $l_5$ is a characteristics curves of the pattern which is not corrected.

FIG. 5B illustrates characteristics curves of the speed (S) with respect to the time (T), $l_6$ is a reference velocity curves, $l_7$ is a corrected curve.

When the velocity of the drive motor 22 slips out of the reference value due to the heavy load of the cage 10, the landing position becomes $(L_1+\Delta L)$ as illustrated by the curve $l_5$. Accordingly, the time point which the cage 10 has been arrived at the position check switch S2 is $(T_2-\Delta T)$ as shown in FIGS. 5A and 5B, nevertheless the reference time is $T_2$. Consequently, in the second comparator circuit 36, there exists a deviation voltage ($\Delta V$) proportioning to the deviation velocity ($\Delta S$) shown in FIG. 5A, between the input voltage of the reference speed setting circuit 38 and the detected voltage of the tachometer generator 24. The deviation voltage ($\Delta V$) is applied to the memory circuit 40 from the second comparator circuit 36, and thereafter the current $i_2$ is supplied to the speed pattern setting circuit 30 depending on the deviation voltage ($\Delta V$). In the speed pattern setting circuit 30, the preset pattern of the speed is corrected depending on the magnitude of the deviation voltage ($\Delta V$). The speed instruction patterns is corrected, as can be seen in FIGS. 5A and 5B particularly curves $l_3$ and $l_5$, in accordance with the correcting magnitude from the error patterns $l_5$ and $l_7$. The drive motor 22 is controlled according to the corrected speed instruction pattern and, in the result, the elevator may take place the ideal landing operation.

Although the velocity of the elevator often changes momentarily in retarding, the value of error obtained at the moment of activation of the switch S2 becomes a memory component.

Although, the above described embodiment, the signal of the tachometer generator 24 for detecting the actual rotation speed of the drive motor 22 is employed as one input signal of the second comparator circuit 36, it is, however, hard to detect accurately an instantaneous value of the rotation speed of the drive motor 22, in case the alternating generator is used as the tachometer generator 24 because of ripple components included therein. It is, therefore, extremely convenience to use the output signal of the speed setting circuit 30 for an input signal to the second comparator circuit 36, as shown by a line 50*a* in FIG. 2B.

According to the control system shown in FIG. 2B, when the elevator cage 10 reached to a reference position and the switch S2 is closed, the deviation signal is obtained in the second comparator circuit 36 by means of comparing the reference speed setting signal presented from the comparator circuit 36 with the speed instruction signal supplied from the speed pattern setting circuit 30, and thereafter the deviation signal is sotred in the memory circuit 40 by closure of the switch S2.

According to the present invention, the landing position of the elevator may be easily adjusted by changing an output resistance value of the variable resistor 28*a*, because a reference of the retarding pattern is a function of time obtained by the integration circuit IC. Furthermore, even if a follow retardation of the control amplifier is not so good, a good characteristic of the stop position may obtain because a value obtained by integrating the error in a given running length is used for correcting the position in motion of the elevator.

For the purposing of increasing the landing accuracy of the elevator and of causing the elevator to be comfortable to ride, it is necessary to solve the various troublesomes in the transient time when the operation of the elevator changes over from the constant driving state to the retarding condition.

These troublesomes, as explained foregoing, is the fact that the mechanical vibration is liable to occur by variations of the speed due to the specific spring system of the elevator, and because the torque characteristic is different between the constant running state and the retarding state of the elevator, as shown by curves $l_{18}$ and $l_{19}$ in FIG. 7 where the curve $l_{18}$ shows the torque characteristic in the motoring state, and the curve $l_{19}$ shows the torque characteristic in retarding state of the drive motor 22, the electrical control system is liable to oscilate particularly in the retardation control state, if the control system has an identical transient gain in the constant speed running state and the retarding driving condition.

To prevent the resonance between the electrical control system and the mechanical system in retardation, if the transient gain is set to high, the elevator itself generates the delay of following to the speed setting pattern as is best shown by the curve $l_6$ and $l_8$ in FIG. 6A, in the result of this, the actual speed $l_8$ of the drive motor 22 overshoot the ideal speed ($l_6$), and accordingly, the suitable retardation may not obtain.

Additionally, the more important drawback is the fact that, when the elevator is conditioned to run at constant velocity and the drive motor is conditioned to the powering, if the motor condition is switch overed from the powering state to the retarding state, the peak current, as shown in a curve $l_{13}$ in FIG. 6C, generates with the windings of the drive motor 22, owing to the interference between the reverse electro motive force and the voltage phase of the power source, and the strong retardation torque yields, and, at the same time, the excessive oscillation occurs in the control system.

The control amplifier circuit 34 may be solve the immediately above problems.

Namely, it is assumed that when the elevator cage 10 reaches the point which the elevator should be slow down, the elevator initially operated by means of the time constant due to the resistor 34*f* and the capacitor 34*g*, and then the elevator is changed to the steady running operation and transferred to the retarding control state by the retarding instruction. In this case as discussed above, it is necessary to change the transient gain in order to make correspond to the driving control and to the retarding control, and the transient gain is reduced (decreased) in the side of the retardation control, since the delay of control develops by the reduction of the transient gain, to avoid it, the initiation value is previously charged on the capacitor 34*e* by means of the bias circuit IB formed by the variable resistor 34*e* and the resistor 34*d*, and thereby the retarding torque is caused to generate.

In this like manner, when the elevator becomes the retardation operation from the constant speed operation, it is preferable to render the speed control amplifier 34 to develop the retarding torque. It is, however, not desirable to make the motoring control output of the speed control amp 34 in order to avoid the generation of abnormal current which generate easily in case of switch over.

In the present invention, the undervoltage relay 44*a* detects that the output has been approximately zero and detects that the retardation signal has been applied to the control amplifier 34 by the contact 44b for retardation. When the elevator is changed from the motoring operation to the retardation control, the bias of the control amplifier 34 is switch overed as shown by the curve $l_{11}$ in FIG. 6B, after the output of the control amplifier 34 has become about zero. When the drive motor 22 from the retardation control to the slow-down control, the output of the control amplifier 34 is positive in the retardation of the motor as illustrated in a curve $l_{10}$ in FIG. 6B, and the positive output of the control amplifier 34 actuates the undervoltage relay 44a. Activation of the undervoltage relay 44a make the contact BX closure, and as a result the control amplifier 34 is switch overed to the retardation transient gain circuit TC. Namely, as can be seen from FIG. 2A, the normal open contact 44b is closed by the retardation instruction presented from the elevator. When the contact 44b closes, undervoltage relay 44a activates the operation, the relay 44c is energized. When the relay 44c is energized, normal open contact BX is closed, and the transient gain decreases. At this time, if the drive motor 22 becomes the retarding condition from the powering state, the tachometer generater 24 detects the condition of the motor 22, and feeds back the detected signal to the control amplifier 34 through the first comparator circuit 32. The output characteristic of the control amplifier 34 becomes the condition as shown by a curve $l_{10}$. Namely, in FIG. 6B, the curve $l_9$ is the output characteristic of the amplifier 34 when the retardation is applied there to form the retarding condition in running, the curve $l_{11}$ is an output characteristic of the amplifier 34 biased by only the gain adjusting circuit 34f, 34g for constant running state and the output overshoot and undershoot with respect to the output ($l_9$) as shown by curve $l_{11}$. According to the control amplifier 34 used in the present invention, with the aid of the time constant circuit TC the transient gain is lowered, and with the aid of the initiation biasing circuit IB, the delay of response is compensated. Accordingly, the response speed is made fast as shown by the curve $l_{10}$ and further the overshoot with respect to the output of the control amplifier 34 is prevented. And, the variation of troque generated at the transient timing becomes small, because of the elimination of peak current ($l_{13}$) of the drive motor 22 as is shown by a dotted line $l_{15}$ in FIG. 6C. Therefore, the driving pattern of the elevator may not so delay and the elevator becomes smoothly driving condition.

As can be easily understood from the foregoing detail explanation, according to the present invention, accuracy of landing is enhanced by means of detecting an agreement or inagreement of the velocity of the elevator with the preset value, and, therefore, it can be obtained a good characteristic elevator system which has a good landing characteristic, being comfortable to ride, and in which smooth retardation and smooth slow down may be performed by switching over the bias timing to be supplied to the control amplifier.

Although the invention has been described with reference certain specific embodiments thereof, numerous modifications falling within the spirit and scope of the invention are possible.

What is claimed is:

1. A control apparatus for an elevator system in which rotational speed of a drive motor for driving said elevator system is controlled by supplying a deviation signal obtained by comparing a speed signal of said drive motor including an induction motor with a driving pattern setting signal, said control apparatus comprising: a retardation time interval setting circuit for setting a retardation time interval for retarding the speed of said drive motor, a speed pattern setting circuit beginning operation depending on a signal from said retardation time interval setting circuit and for setting a retarding pattern of said elevator, a speed pattern correcting circuit storing a deviation signal obtained by comparing a signal corresponding to an output signal of said speed pattern setting circuit with a reference speed setting signal of a reference speed setting circuit and applying said deviation signal to said speed pattern setting circuit for correcting said speed pattern, a comparator circuit for generating a deviation signal between said output signal of said speed pattern setting circuit and the signal proportional to said rotational speed of the drive motor, and a speed control circuit for amplifying and controlling said deviation signal and for supplying said amplified and controlled deviation signal to said drive motor as a control signal, said speed control circuit comprising a control amplifier circuit for controlling and amplifying said deviation signal of said comparator circuit, a gate control circuit for controlling a voltage to be applied to said drive motor in response to an output signal of said comparator circuit, and a gain adjusting instruction circuit for supplying a bias to said control amplifier circuit in changing said drive motor from a powering state to a retarding state thereof.

2. A control apparatus for an elevator system as claimed in claim 1, wherein said control amplifier circuit comprises an amplifier including an operational amplifier for controlling an error signal detected by said comparator circuit between actual rotational speed value with respect to a reference rotational speed value, a transient gain constant circuit for reducing a transient gain of said operation amplifier and having a series-connected circuit of a resistor and a capacitor, a switch set to an on state by means of an instruction signal of said gain adjusting instruction circuit when detecting an output of said operational amplifier and thereby being in an operative state, and a bias circuit including a resistor and variable resistor and for supplying an initiation bias signal to said operational amplifier.

3. A control apparatus for an elevator system as claimed in claim 1, wherein said control amplifier circuit includes a gain adjusting instruction circuit for detecting when said output voltage has been zero and thereby becoming activated.

4. A control apparatus for an elevator system as claimed in claim 1, wherein said gain adjusting instruction circuit includes an undervoltage relay, a switch turned on by means of retardation instruction of the elevator, and a relay energized by said retardation instruction of the elevator, and a relay energized by said retardation instruction of the elevator and thereby turning on said switch of the control amplifier circuit.

* * * * *